US006343912B1

(12) United States Patent
Manteiga et al.

(10) Patent No.: US 6,343,912 B1
(45) Date of Patent: Feb. 5, 2002

(54) GAS TURBINE OR JET ENGINE STATOR VANE FRAME

(75) Inventors: John A. Manteiga, North Andover; Jeffrey H. Nussbaum, Wilmington; John L. Noon, Swampscott, all of MA (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/456,967

(22) Filed: Dec. 7, 1999

(51) Int. Cl.[7] ..... F01D 5/00

(52) U.S. Cl. ..... 415/138; 415/139; 415/191; 415/208.2

(58) Field of Search ..... 415/191, 138, 415/139, 189, 208.2, 209.2, 210.1

(56) References Cited

U.S. PATENT DOCUMENTS 3,752,598 A * 8/1973 Bowers et al. ..... 415/173
4,492,517 A * 1/1985 Klompas ..... 415/139
5,957,658 A * 9/1999 Kasprow et al. ..... 415/134

* cited by examiner

*Primary Examiner*—Edward K. Look
*Assistant Examiner*—James M McAleenan
(74) *Attorney, Agent, or Firm*—Andrew C. Hess; Nathan D. Herkamp

(57) ABSTRACT

A stator vane frame assembly including an outer structure ring, an inner structure ring, a set of discrete vanes each connecting the outer structure ring and the inner structure ring forming an inner and outer platforms with neighboring vanes defining a set of flow paths, a set of sealing members contoured to a set of gaps between the set of vanes disposed to sealing the gap. A method for applying a sealing member to the gaps between a platform formed resulting from the coupling between vanes including affixing a set of stator vanes on an inner frame and an outer frame, and sealing a set of sealing members on the backside surface of a stator vane frame. The discrete nature of individual vane blade sealed by the sealing members renders the stator vane frame assembly to add a damping effect which increases the fatigue life of the vane, and permits the use of lower strength, lighter, and less expensive material.

10 Claims, 3 Drawing Sheets

GAS TURBINE OR JET ENGINE STATOR VANE FRAME

BACKGROUND OF THE INVENTION

This invention relates to gas turbine or jet engines, and, more particularly, to gas turbine or jet engine stator vane frames.

As is known, the inner surface of a compressor casing, in gas turbine or jet engines, is machined with circumferential T-section grooves to retain stator blades therein. Engines also include variable outlet guide vanes to direct flow alignment. In this case variable vane bearing seats are formed by radial holes and counterbores through circumferential supporting ribs. Stator blades are locked in the compressor casing, forming a platform either directly through T-grooves or by retaining rings. In order to efficiently use the compressed air flowing through the vanes, the casing needs to be suitably sealed. Also, vane vibration results in platform deflection, which causes shearing motion relative to separate and integral part of a stator vane frame assemble. A gasket is provided around the frames to seal the air path. However, the low damping effect of the vane frame can lead to vibratory stresses which exceed material strength, and which may result in vane cracking and other failures.

BRIEF SUMMARY OF THE INVENTION

In an exemplary embodiment of the invention a stator vane frame assembly includes an outer structure ring, an inner structure ring, a set of vanes connecting the outer structure ring and the inner structure ring, that forms inner and outer platforms, a set of flow paths, a set of sealing members contoured to a set of gaps between the set of vanes disposed to sealing the gap. Also, a spacer in between the frame and the vane platform is eliminated in that the sealing members perform the function of the spacer.

In addition, vibratory stresses are reduced by the damping effect caused by the introduction of sealing members disposed to seal individual or discrete vanes. Each individual vane is connected together with some other members of the set of vanes. Gaps between the vanes are sealed on the backside by a sealing member to enhance a damping effect so that metal fatigue of the relevant metal parts is reduced. Also, vane cracking and other failures are reduced as well. In addition, the added damping provided by the sealing members increases the fatigue life of the vanes, as well as permitting the use of lower strength, lighter, and less expensive materials.

DETAILED DESCRIPTION OF THE INVENTION

Figure 1:
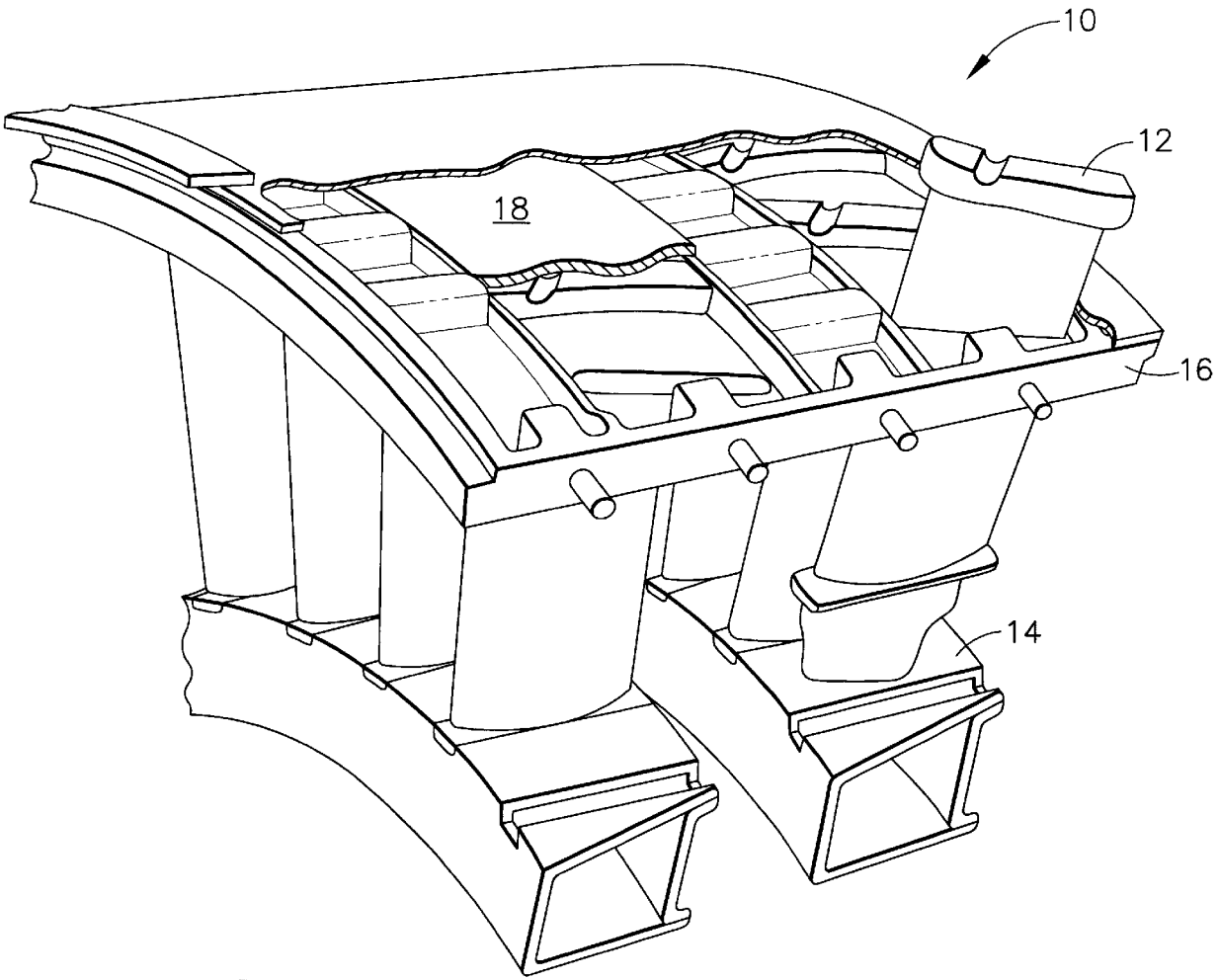
FIG. 1 (PRIOR ART)
FIG. 1 is a partial perspective view of a stator vane from assembly of the prior art.

Referring to prior art FIG. 1, a stator vane frame assembly 10 is generally shown. Stator vane frame assembly 10 has individual vanes 12 which are connected to an inner frame 14 as well as an outer frame 16. A gasket 18 is rapped around the outer frame 16. Similarly, another gasket (not shown) may rap around inner frame 14. Such a stator vane frame assembly is well known in the art.

Figure 2:
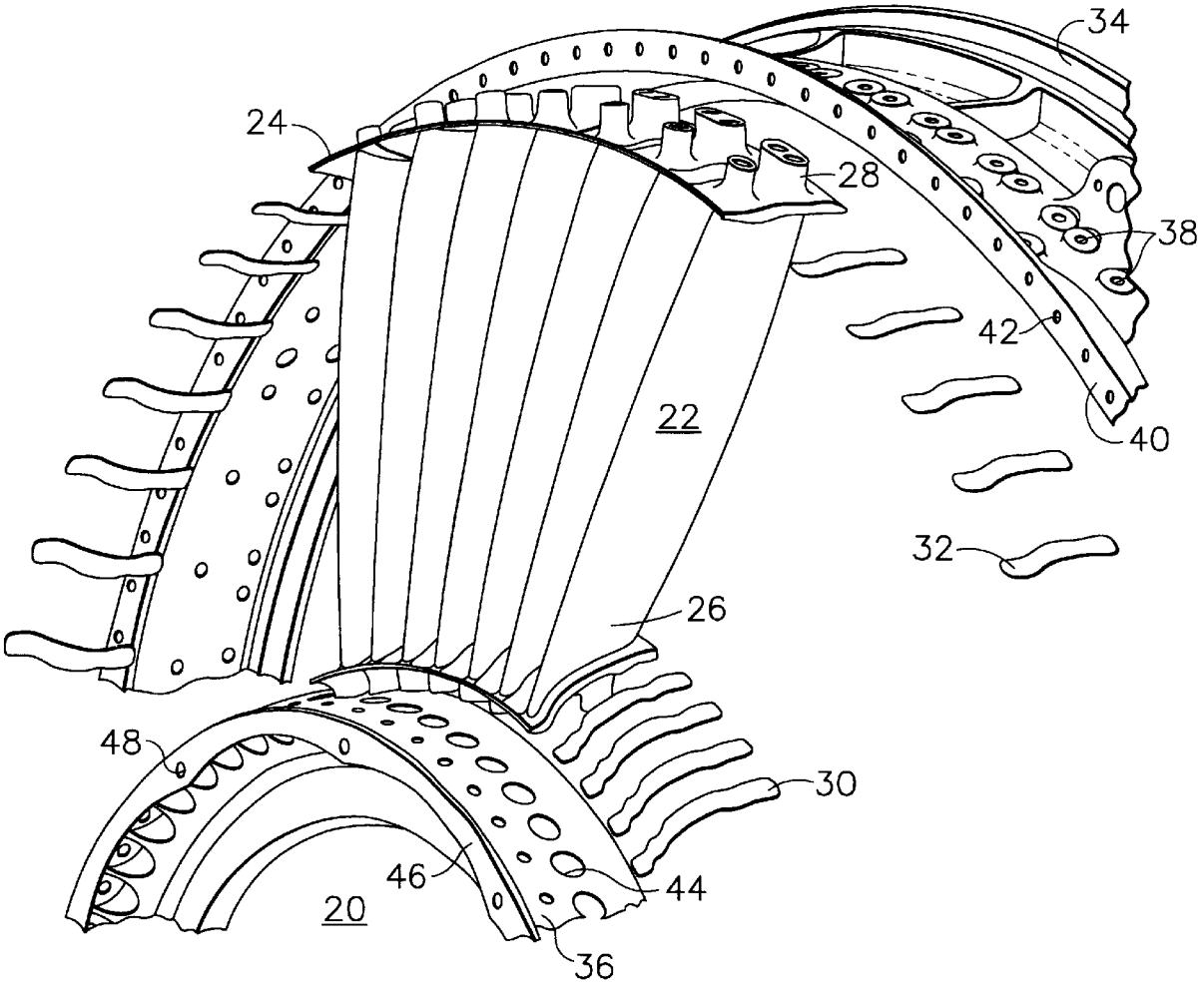
FIG. 2 is a perspective semi-exploded view of a fan outlet guide vane frame.

Referring to FIG. 2, a fan outlet guide vane frame of an exemplary embodiment is generally shown at 20. Individual vanes 22 having integral flowpath platforms 24 form an inner flowpath surface 26 as well as an outer flowpath surface 28. A set of inner strips 30 and a set of outer strips 32 seal the gaps between platforms 24. The set of inner strips 30 and the set of outer strips 32 are contoured in such a way that optimum sealing and damping effects are achieved. The inner strips 30 and the outer strips 32 are contoured to match the shape of the platforms 24 and affixed on the backside of the platforms 24 using a suitable adhesive such as a room temperature vulcanizing sealant (e.g., RTV). An outer structure ring 34 and an inner structure ring 36 have individual vanes 22 bolted thereto. The outer structure ring 34 has bolting holes 38 for connecting the vanes 22. Similarly, the outer structure ring 34 has a side rim 40 for connecting with a neighboring structure ring via a set of holes 42. The inner structure ring 36 has a set of bolting holes 44 for connecting the vanes 22. Similarly, the inner structure ring 36 has side rim 46 for connecting with a neighboring structure ring via a set of holes 48.

Figure 3:
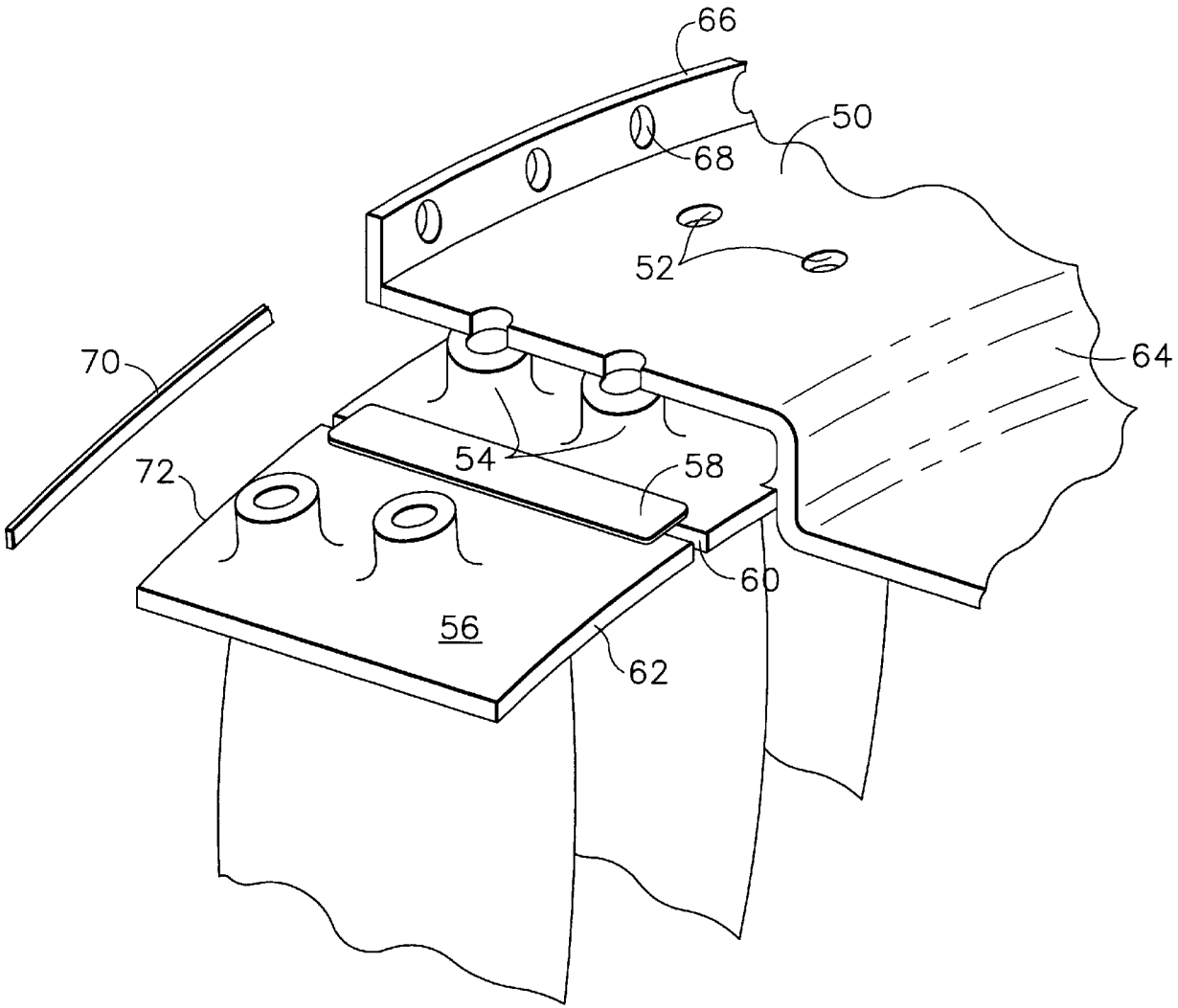
FIG. 3 is a partial perspective view of the outlet guide vane assembly.

Referring to FIG. 3, an outlet guide vane frame outer ring 50 has holes 52 for bolting the reciprocal holes 54 on a vane platform 56. An aluminum damper strip 58 is bounded by a suitable room temperature vulcanization sealant to the vane platform 56 sealing a gap 60 on the vane platform 56. The vane platform 56 defines a first edge 62 that connects to a first rim 64 of the outer ring 50 via a room temperature vulcanization sealant bead. The outer ring 50 further defines a second rim 66, which has connecting holes 68 for connection with neighboring systems. In another embodiment of FIG. 3, a sealing strip 70 may be applied to a second edge 72 of the vane platform 56.

It is to be noted that vane vibration results in platform deflection, which causes relative shearing motion through the adhesive to the seal strips. This relative motion results in viscous damping that absorbs energy. The adhesive is suitably chosen for its environmental bonding and viscous damping characteristics. The quality of the connecting elements determines an optimum damping state. Parameters such as the choice of material, thickness, bonded surface area and a number of layers are suitably selected to provide the best viscous damping.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed:

1. A stator vane assembly comprising:

an outer structure ring including a rim;

an inner structure ring;

a plurality of vanes extending radially from said inner structure ring to said outer structure ring; each said vane being attached at an inner end to said inner structure ring and at an outer end to said outer structure ring, each said vane including an inner platform and an outer platform;

a plurality of sealing members positioned across a plurality of gaps formed between adjacent ones of said inner and outer platforms, each of said plurality of sealing members being bonded to said platforms by an adhesive sealant.

2. The assembly of claim 1 wherein said adhesive sealant has viscous vibration damping characteristics.

3. The assembly of claim 2, said sealant being a room temperature vulcanizing sealant.

4. The assembly of claim 2 being located within a gas turbine.

5. The assembly of claim 2 being located within a jet engine.

6. The assembly of claim 2 wherein the outer structure ring and the inner structure ring comprises part of an outlet guide vane frame.

7. The assembly of claim 2 wherein the set of vanes are bolted to the outer structure ring and inner structure ring.

8. The assembly of claim 2, said vanes extending in a flow path, each said sealant members being bonded to an outer side of said platforms facing away from said flow path.

9. The assembly of claim 2, each said outer platform having a first edge abutting and bonded to a first rim of the outer structure ring by adhesive sealant.

10. The assembly of claim 9, each said outer platform having a second edge opposite said first edge, said assembly further comprising a sealing strip applied to said second edge.

* * * * *